US008074307B2

(12) United States Patent
Spratley

(10) Patent No.: US 8,074,307 B2
(45) Date of Patent: Dec. 13, 2011

(54) AIR CIRCULATION AND BED-COVER SUSPENSION UNIT FOR A BED

(76) Inventor: David Derek Grant Spratley, Richmond (GB)

( * ) Notice: Subject to any disclaimer, the term of this patent is extended or adjusted under 35 U.S.C. 154(b) by 1297 days.

(21) Appl. No.: 11/572,876

(22) PCT Filed: Jul. 28, 2005

(86) PCT No.: PCT/GB2005/002958

§ 371 (c)(1),
(2), (4) Date: Jan. 29, 2007

(87) PCT Pub. No.: WO2006/010932

PCT Pub. Date: Feb. 2, 2006

(65) Prior Publication Data

US 2008/0015666 A1 Jan. 17, 2008

(30) Foreign Application Priority Data

Jul. 30, 2004 (GB) ..... 0417045.2

(51) Int. Cl.

| | |
|---|---|
| ***A47C 21/02*** | (2006.01) |
| *A47C 21/00* | (2006.01) |
| *A47C 31/00* | (2006.01) |
| *A47C 21/04* | (2006.01) |
| *A47C 27/00* | (2006.01) |
| *A61F 7/00* | (2006.01) |
| *F25D 23/12* | (2006.01) |

(52) U.S. Cl. ..... 5/506.1; 5/423; 5/421; 5/503.1; 5/505.1; 5/504.1; 62/261

(58) Field of Classification Search ..... 5/421, 423, 5/503.1, 505.1, 506.1, 504.1; 62/261
See application file for complete search history.

(56) References Cited

U.S. PATENT DOCUMENTS

| | | | | |
|---|---|---|---|---|
| 1,106,474 | A | 8/1914 | Persson | |
| 1,112,514 | A * | 10/1914 | Zimmermann | 5/505.1 |
| 2,105,108 | A | 1/1938 | Crosley, Jr. | |
| 2,220,447 | A * | 11/1940 | Hartman | 128/204.16 |
| 3,306,289 | A * | 2/1967 | Cameto et al. | 128/200.14 |
| 3,713,182 | A | 1/1973 | McNeal | |
| 3,999,541 | A | 12/1976 | Tabor | |
| 4,506,511 | A | 3/1985 | Cameto et al. | |
| 4,602,486 | A | 7/1986 | Weinstein | |
| 4,937,903 | A | 7/1990 | Joly et al. | |
| 6,425,255 | B1 | 7/2002 | Hoffman | |
| 2004/0242148 | A1 * | 12/2004 | Schmid et al. | 454/329 |

FOREIGN PATENT DOCUMENTS

| | | |
|---|---|---|
| GB | 12206 | 11/1913 |
| GB | 1085791 | 10/1967 |
| JP | 2002-51875 A | 2/2002 |

* cited by examiner

*Primary Examiner* — Jonathan Liu
(74) *Attorney, Agent, or Firm* — Rodman & Rodman

(57) ABSTRACT

An air circulation unit introduces air into a space under the bed cover from a foot-end of a bed. The air circulation unit includes an assembly for suspending the bed cover so that an occupant or occupants of the bed are partially relieved of the full weight of the bed cover. In use, the unit serves to introduce air which may be heated or cooled or at ambient temperature into the space under the bed cover and so circulate air over the occupant or occupants of the bed to keep the occupant or occupants as comfortable as possible during sleep despite surrounding conditions.

14 Claims, 4 Drawing Sheets

AIR CIRCULATION AND BED-COVER SUSPENSION UNIT FOR A BED

The present invention relates to an air circulation unit for a bed and in particular to a unit which circulates air under the bed cover of a bed in order to cool the occupant or occupants of the bed whilst at the same time suspending the cover above the sleepers in desired position.

In a number of countries where the temperature remains high during the night and in countries with uncomfortably cold nights, it often becomes uncomfortable to sleep. I have now devised a unit for alleviating these difficulties.

In accordance with the present invention, there is provided an air circulation unit which comprises means for introducing temperature controlled air into the space under the bed cover, and means from which, in use, the bed cover is suspended from above.

In use of this unit, the bed cover is partially lifted by its suspension arrangement, to create or enlarge a space under the bed cover, for the introduction of air. This introduction of air promotes a circulation of air over the occupant or occupants of the bed, under the bed cover, and so serves to warm or cool the bed occupant or occupants.

Preferably, the unit comprises an upright body to which or in which an air circulation fan is mounted: preferably, in use, this upright body is positioned at the foot of the bed.

Preferably a suspension assembly extends generally horizontally over the bed, from the top of the upright body of the unit. Preferably the suspension assembly comprises an elongate support, which is preferably telescopic, for extending lengthwise of the bed. Preferably, a number of arms extend laterally from the elongate support. Preferably, a number of height adjustable cords or other elongate flexible filaments are suspended from these arms, and optionally from the elongate support, and are provided at their lower ends, with means for fastening to the bed cover. Preferably these fastening means comprise clips for gripping the bed cover: preferably each such fastening means is arranged to release should it experience a tensile force of greater than a predetermined amount, so that the fastening means will release should the occupant of the bed pull too forcefully on the bed cover. Preferably the suspension assembly is mounted to a vertically-adjustable part of the upright body which is preferably adjusted by remote control. Preferably a foot assembly extends from the base of the upright body, to extend under the bed and counter any tendency of the unit to topple over.

The unit may include cooling means for cooling the air which it delivers, and/or heating means for warming the air which it delivers. Preferably the unit permits the user to select, using a remote control pad preferably, whether cooled air, warm air, or air at ambient temperature is delivered by the unit. Where the unit comprises means for cooling or heating the air, preferably it includes a thermostatic control to ensure that the air temperature in the space under the bed does not become excessively cool or warm.

An embodiment of the present invention will now be described by way of example only and with reference to the accompanying drawings, in which.

Figure 1:
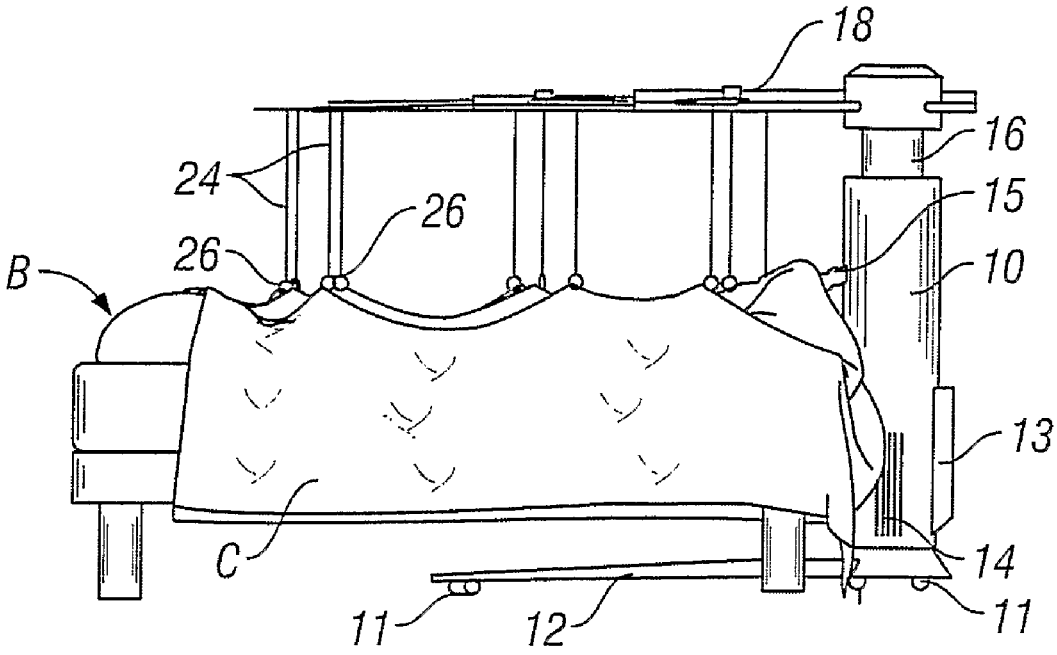
FIG. 1 is a side view of a bed provided with an air circulation unit in accordance with the present invention.
Figure 2:
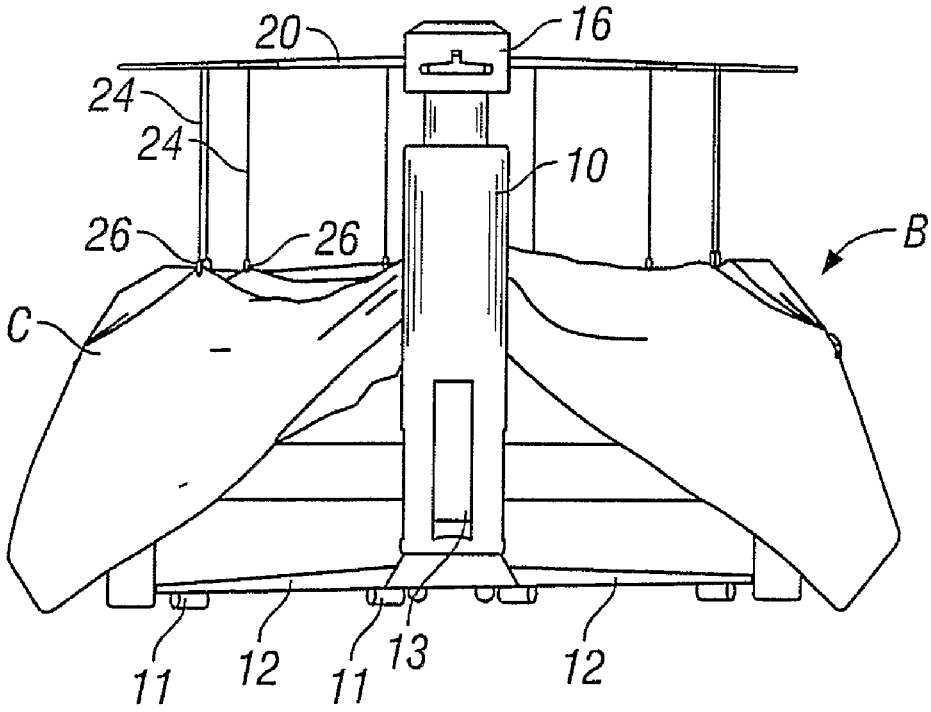
FIG. 2 is a view of the bed and air circulation unit from the foot end of the bed.
Figure 3:
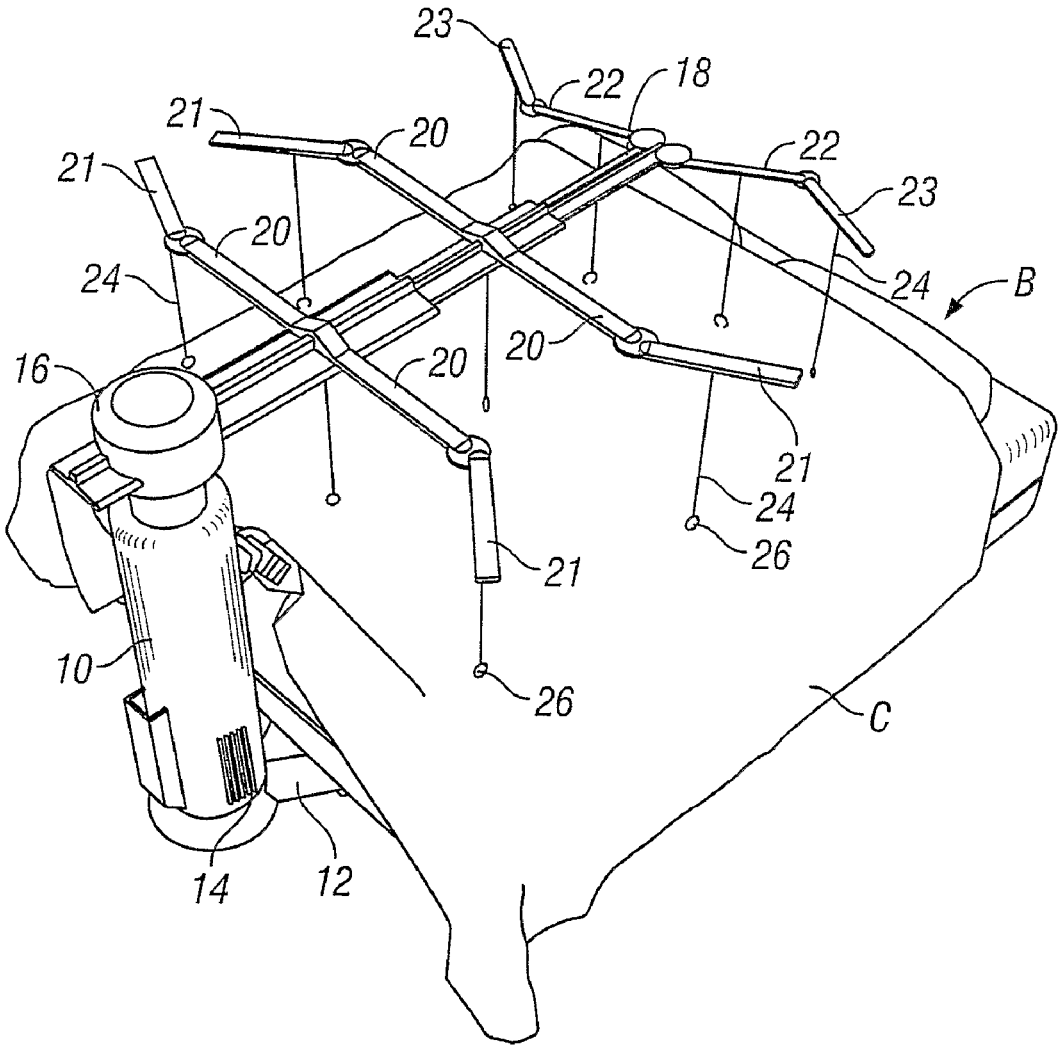
FIG. 3 is an isometric view of the bed and air circulation unit from the foot end and one side of the bed.
Figure 4:
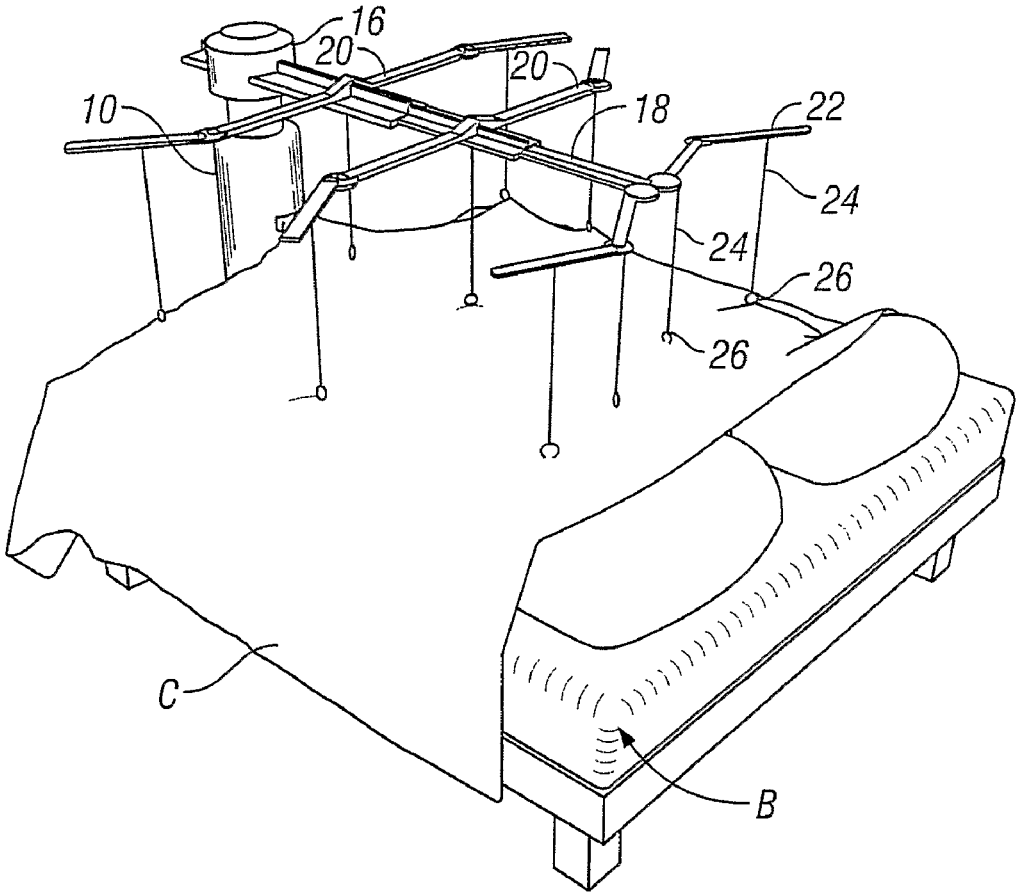
FIG. 4 is an isometric view of the bed and air circulation unit from the head end and same side of the bed.
Figure 5:
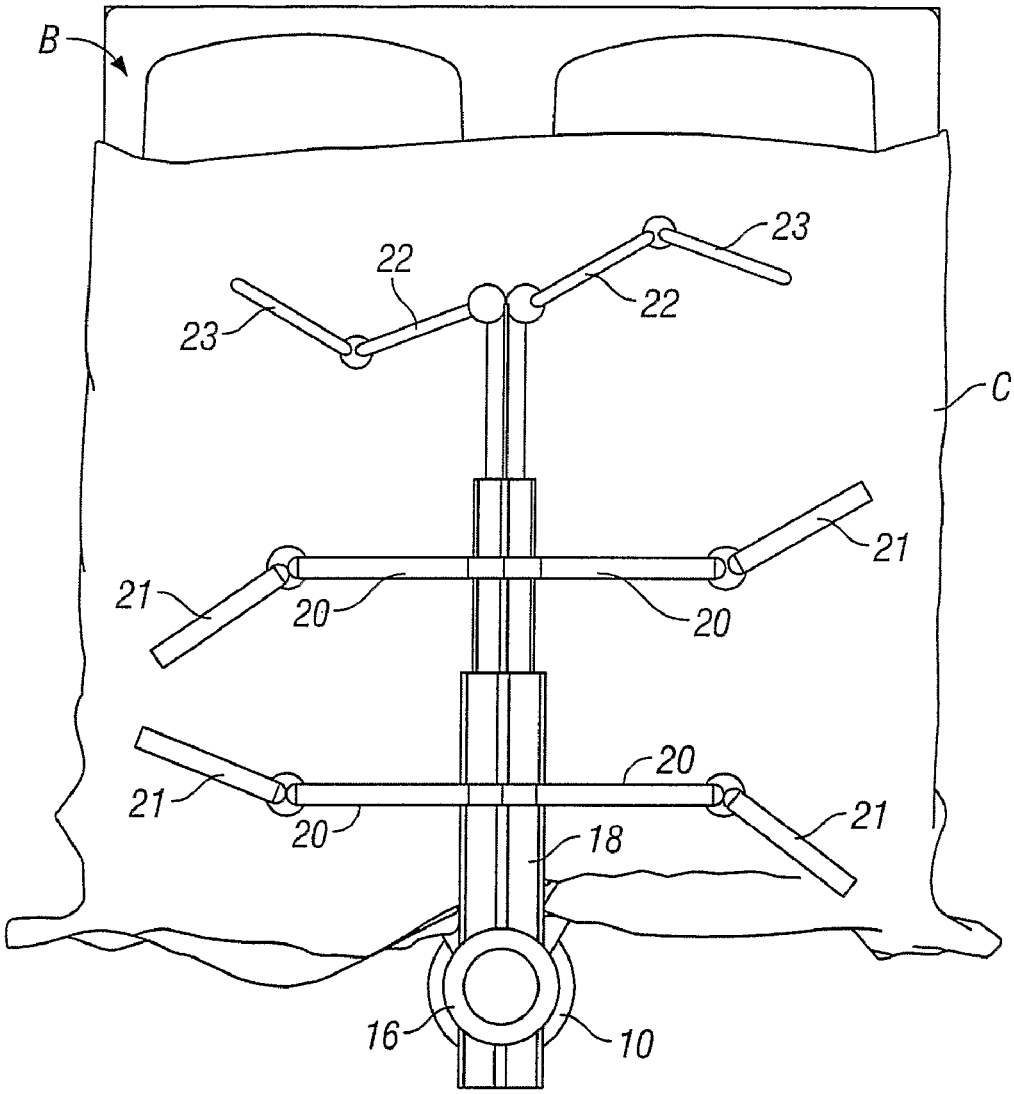
FIG. 5 is a plan view of the bed and air circulation unit.

Referring to the drawings, there is shown a bed B having a bed cover C, and an air circulation unit for introducing air into the space under the bed cover C from the foot-end of the bed.

The air circulation unit comprises an upright, tubular housing 10, which stands at the foot of the bed B and has a pair of telescopic elongate feet 12 projecting in diverging directions from the base of the housing 10 and extending under the bed B. The housing 10 encloses an air circulation fan (not shown) which draws in air via inlets 14 formed in opposite sides of the housing adjacent its base, and expels this air through a flexible delivery pipe 15 which projects from the housing 10 and extends into the space under the bed cover C. The delivery pipe has an outlet nozzle concave in shape (not shown) which disperses air widely.

The air circulation unit also comprises an assembly for suspending the bed cover C so that the occupant or occupants of the bed B are partially relieved of the full weight of the bed cover. This assembly comprises a telescopic upper part 16 of the housing 10 and a 3-part, elongate, telescopic support 18 which projects horizontally from the top of the upper part 16 of the housing 10, to extend lengthwise of the bed B towards its head-end, the telescopic support 18 is screwed tightly in position by a screw cap positioned at the top of the housing 10. A pair of arms 20 project horizontally in opposite transverse directions from end of the inner and intermediate sections of the support 18, and have respective outer arm sections 21 which are coupled to the inner arm sections for pivoting about respective vertical axes. A pair of arms 22 project horizontally from the outer end of the outer section of the support 18 and are coupled thereto for pivoting about respective vertical axes: the arms 22 have respective outer sections 23 which are coupled to the inner arm sections for pivoting about respective vertical axes.

A number of height adjustable cords 24 hang down from the support 18 and its arms 20 and have clips 26 attached to their lower ends: the clips 26 grip the bed cover C at spaced-apart points. The cords 24 are attached to sliders on the arms 20 which allow for them to be moved laterally into desired position.

The upper part 16 of the housing 10 can be adjusted vertically to set the support 18 and its arms 20 to a desired height preferably adjusted by remote control. The support 18 can be adjusted lengthwise, in telescopic manner, according to the length of the bed or the proportion of the bed cover C which the occupants of the bed wish to have suspended. The various arms or arm sections 21, 22, 23 are pivoted to desired positions to enable the clips 26, suspended from the cords 24 from these arms or arm sections, to be applied to the bed cover C at the desired height and location, in order to lift the bed cover as desired by the occupant or occupants of the bed.

In use, the unit serves to introduce air into the space under the bed cover C and so circulate air over the occupant or occupants of the bed and to suspend the cover above the occupants of the bed. The housing 10 may include means for cooling and/or heating the air, so that the user may select whether cooled, warmed or air at ambient temperature is circulated.

The lateral arms 20 are designed to be flexible so that the movements of the occupant or occupants of the bed will not cause the clips 26 to release its grip on the covers. However each of the clips 26 is arranged to release if the cord to which it is attached is subjected to predetermined tension, due to forces applied to the bed cover C: therefore, should an occupant of the bed pull the cover forcefully, the one or more of the clips 26 will release, so preventing the unit being pulled over.

The telescopic support 18 enables the bed cover C to be pushed back towards the foot of the bed, whilst leaving the bed cover suspended from the unit and ready for re-use.

The air delivery pipe 15 is flexible but self-supporting so that it can be adjusted to select the height of its outlet, which is preferably provided with a convex shaped nozzle for dispersing air directionally wide, as desired by the user. The delivery pipe also has a clip of its upper side to hold the bed cover in position.

The housing 10 and its feet 12 are supported on casters 11 to enable the unit to be moved easily over the floor. The feet 12 and the support 18 and its arms 20,22 may be disassembled when use of the unit is not required, these components then being stored vertically in pockets e.g. 13 provided on the housing 10.

The unit incorporates telescopic arms 20 and telescopic elongate feet so that the unit is easily stored away. Preferably the telescopic support 18 can either be removed from unit 10 and stored in a pocket positioned on the rear side of central support 10 or cantilevered vertically by means of a pivot where they attach to the housing 10.

The invention claimed is:

1. An air circulation unit comprising, a) an upright body having an upper portion and a lower base portion, b) a suspension assembly, including an elongated telescopic support extending generally horizontally from the upper portion of the upright body, c) the elongated telescopic support having a plurality of pivotal arms extending laterally from the telescopic support, d) each of the pivotal arms having at least one depending, height adjustable, elongated, flexible filament, each said flexible filament having a lower end with a fastener for respectively engaging a bed cover at selected locations, for supporting the bed cover above a bed, to create or enlarge a space under the bed cover, e) an apparatus cooperable with said upright body for introducing temperature controlled air into the space under the bed cover.

2. An air circulation unit according to claim 1, wherein the upright body includes said apparatus, the apparatus comprising an air circulation fan.

3. An air circulation unit according to claim 2, wherein the upright body is free standing and positionable at a foot end of a bed.

4. An air circulation unit according to claim 1, wherein the telescopic elongate support is lengthwise extendable along the length of a bed.

5. An air circulation unit according to claim 1, wherein a plurality of height adjustable elongate flexible elements extend from the elongate support and are provided at their lower ends with fasteners for fastening to the bed cover.

6. An air circulation unit according to claim 5, wherein the fasteners comprise clips for gripping the bed cover.

7. An air circulation unit according to claim 6, wherein each of the fasteners have a predetermined grip and is arranged to release under a tensile force of greater than the predetermined grip.

8. An air circulation unit according to claim 1, wherein the upright body has a vertically adjustable portion and the suspension assembly is mounted to the vertically-adjustable portion of the upright body.

9. An air circulation unit according to claim 8, including remote control means for remotely controlling vertical adjustment of the vertically-adjustable adjustable portion.

10. An air circulation unit according to claim 9, wherein the upright body includes a foot assembly extending from the base portion of the upright body.

11. An air circulation unit according to claim 1, wherein the apparatus is arranged to deliver warm or cool air to the space under the bed cover.

12. An air circulation unit according to claim 11, including a selector to enable a user to select whether cooled air, warm air, or air at ambient temperature is delivered by the apparatus.

13. An air circulation unit according to claim 12, including a remote control pad for operating the selection means.

14. An air circulation unit according to claim 1, including a thermostat for controlling the air temperature in the space under the bed cover.

* * * * *